US009290286B2

(12) United States Patent
Ehmer

(10) Patent No.: US 9,290,286 B2
(45) Date of Patent: Mar. 22, 2016

(54) METHOD AND APPARATUS FOR PREPARING AND FILLING PACKAGES INCLUDING POUCHES AND CONTAINERS, SUCH AS POUCHES AND CONTAINERS FOR FOOD PRODUCTS

(75) Inventor: Wilfried Ehmer, Dortmund (DE)

(73) Assignee: KHS GmbH, Dortmund (DE)

( * ) Notice: Subject to any disclaimer, the term of this patent is extended or adjusted under 35 U.S.C. 154(b) by 912 days.

(21) Appl. No.: 12/568,852

(22) Filed: Sep. 29, 2009

(65) Prior Publication Data

US 2010/0077701 A1 Apr. 1, 2010

Related U.S. Application Data

(63) Continuation-in-part of application No. PCT/EP2008/002050, filed on Mar. 14, 2008.

(30) Foreign Application Priority Data

Mar. 30, 2007 (DE) ..... 10 2007 015 754

(51) Int. Cl.
*B65B 55/10* (2006.01)
*A61L 2/20* (2006.01)
*B65B 55/02* (2006.01)

(52) U.S. Cl.
CPC ..... *B65B 55/027* (2013.01); *B65B 55/10* (2013.01); *B65B 55/103* (2013.01)

(58) Field of Classification Search
CPC ..... B65B 55/00; B65B 55/025; B65B 55/08; B65B 55/10; B65B 55/103; B65B 55/24
USPC ..... 53/425, 426, 467, 473, 111 R, 510; 422/28, 295
See application file for complete search history.

(56) References Cited

U.S. PATENT DOCUMENTS 3,716,961 A * 2/1973 Cope et al. ..... 53/434
3,744,209 A * 7/1973 Conley et al. ..... 53/426
3,783,581 A 1/1974 Pierce (Continued)

FOREIGN PATENT DOCUMENTS

DE 40 07 714 A1 9/1991
DE 42 09 838 A1 9/1993

(Continued)

OTHER PUBLICATIONS

International Search Report PCT/EP2008/0020501 and English translation thereof.

*Primary Examiner* — Gloria R Weeks
(74) *Attorney, Agent, or Firm* — Nils H. Ljungman & Associates

(57) ABSTRACT

A method and apparatus for the sterilizing of packaging material and/or packages is disclosed herein. The method comprises disposing the packaging material and/or packages in a sterilization device and pressurizing a pressure medium in the sterilization device to at least a pressure sufficient to at least inhibit reproductive capabilities of microorganisms disposed with the packaging material and/or packages. The apparatus is configured to receive packaging material and/or packages and a pressure medium in a sterilization device configured to pressurize the pressure medium in the sterilization device to at least a pressure sufficient to at least inhibit reproductive capabilities of microorganisms disposed with the packaging material and/or packages.

10 Claims, 3 Drawing Sheets

(56) References Cited

U.S. PATENT DOCUMENTS 3,854,874 A * 12/1974 Loliger et al. ..... 422/299
3,899,862 A * 8/1975 Muys et al. ..... 53/426
3,942,299 A * 3/1976 Bory ..... 53/425
3,944,387 A * 3/1976 Schreckendgust ..... A61L 2/206 141/95
4,056,921 A * 11/1977 Gilliand et al. ..... 53/167
4,112,124 A * 9/1978 Jarvis ..... 426/234
4,193,818 A * 3/1980 Young ..... B08B 3/12 134/1
4,296,068 A * 10/1981 Hoshino ..... 422/62
4,349,508 A * 9/1982 Liede ..... B65B 55/10 422/1
4,366,125 A * 12/1982 Kodera ..... A61L 2/10 422/20
4,396,582 A * 8/1983 Kodera ..... 422/300
4,494,363 A * 1/1985 Rica et al. ..... 53/426
4,656,813 A * 4/1987 Baldini et al. ..... 53/410
4,680,163 A * 7/1987 Blidschun et al. ..... 422/28
4,707,334 A 11/1987 Gerhard
4,710,350 A * 12/1987 Petersen ..... 422/37
4,770,851 A * 9/1988 Joslyn ..... 422/26
4,788,811 A * 12/1988 Kawajiri et al. ..... 53/426
4,797,255 A * 1/1989 Hatanaka et al. ..... 422/28
4,944,132 A * 7/1990 Carlsson et al. ..... 53/167
5,064,614 A 11/1991 Reiss et al.
5,069,017 A * 12/1991 Fabricius ..... 53/426
5,623,810 A * 4/1997 Dey ..... B65B 9/04 53/281
5,997,827 A * 12/1999 Mezger et al. ..... 422/292
6,012,267 A * 1/2000 Katsumata ..... B65B 55/02 53/425
6,036,928 A * 3/2000 Barnstead ..... A61L 2/02 137/587
6,145,284 A * 11/2000 Eggers ..... 53/559
6,230,472 B1 * 5/2001 Stahlecker ..... 53/426
6,397,557 B1 * 6/2002 Bassissi et al. ..... 53/51
6,457,299 B1 * 10/2002 Schwenke et al. ..... 53/510
6,510,669 B1 * 1/2003 Bellei et al. ..... 53/167
6,537,492 B1 * 3/2003 Søgaard ..... 422/21
6,684,607 B2 * 2/2004 Ng ..... A47L 15/0076 53/167
6,821,443 B2 * 11/2004 Kim ..... 210/760
6,826,892 B2 * 12/2004 Basque ..... B31B 19/84 53/133.2
6,957,523 B2 * 10/2005 Siccardi ..... B65B 55/02 422/82.01
7,007,441 B2 * 3/2006 Benedetti et al. ..... 53/167
7,021,030 B1 * 4/2006 Burns ..... B09B 3/00 242/538
7,093,405 B2 * 8/2006 Andersson et al. ..... 53/167
7,533,512 B2 * 5/2009 Levati ..... B65B 31/024 53/167
7,594,372 B2 * 9/2009 Micnerski ..... B31B 19/88 53/453
8,375,686 B2 * 2/2013 Caudle ..... B65B 55/103 53/433.1
8,387,348 B2 * 3/2013 Caudle ..... B65B 61/186 53/133.1
8,574,371 B2 * 11/2013 Folz et al. ..... 134/7
8,621,824 B2 * 1/2014 Mielnik et al. ..... 53/167
8,833,594 B2 * 9/2014 Stahl ..... A47F 3/14 206/557
2003/0103863 A1 * 6/2003 Grislain et al. ..... 422/1
2004/0123883 A1 * 7/2004 Pritchard ..... B29C 65/18 134/63
2005/0076612 A1 * 4/2005 Andersson et al. ..... 53/167
2005/0123435 A1 6/2005 Cutler et al.
2005/0126117 A1 * 6/2005 Benedetti et al. ..... 53/167
2005/0188651 A1 * 9/2005 Clusserath ..... 53/136.1
2005/0252176 A1 * 11/2005 Pritchard ..... 53/469
2006/0159583 A1 * 7/2006 Naslund et al. ..... 422/22
2007/0266677 A1 * 11/2007 Nagatani ..... B65B 55/025 53/467
2007/0292305 A1 * 12/2007 Dempsey ..... A61L 2/206 422/28
2009/0094940 A1 * 4/2009 Py ..... 53/267
2009/0223173 A1 * 9/2009 Rapparini ..... 53/425
2011/0006225 A1 * 1/2011 Fletcher et al. ..... 250/492.3
2011/0283661 A1 * 11/2011 Miller ..... A61L 2/10 53/425
2014/0083051 A1 * 3/2014 Mielnik et al. ..... 53/426

FOREIGN PATENT DOCUMENTS

DE 196 26 705 A1 1/1998
DE 102005017404 10/2006
DE 102005027811 12/2006
EP 0 206 096 A 12/1986
EP 0 312 022 A2 4/1989
EP 0588010 3/1994
EP 1 327 392 A1 7/2003
FR 2 818 615 A 6/2002
GB 1 166 010 A 10/1969
JP 2001-163310 A 6/2001
JP 2003-300508 A 10/2003
JP 2005517420 6/2005
WO WO 99/08861 A 2/1999
WO WO 99/21593 A1 5/1999
WO WO 03/003845 A2 1/2003
WO WO 2005/120960 12/2005

* cited by examiner

METHOD AND APPARATUS FOR PREPARING AND FILLING PACKAGES INCLUDING POUCHES AND CONTAINERS, SUCH AS POUCHES AND CONTAINERS FOR FOOD PRODUCTS

CONTINUING APPLICATION DATA

This application is a Continuation-In-Part application of International Patent Application No. PCT/EP2008/002050, filed on Mar. 14, 2008, which claims priority from Federal Republic of Germany Patent Application No. 10 2007 015 754.3, filed on Mar. 30, 2007. International Patent Application No. PCT/EP2008/002050 was pending as of the filing date of this application. The United States was an elected state in International Patent Application No. PCT/EP2008/002050.

BACKGROUND

1. Technical Field

The present application relates to a method and apparatus for preparing and filling packages including pouches and containers, such as pouches and containers for food products.

2. Background Information

Background information is for informational purposes only and does not necessarily admit that subsequently mentioned information and publications are prior art.

Cleaning equipment and methods are widely known in the food and beverage industry. The technology for solid rigid containers such as bottles or the like that represent a monolithic body produced by blowing and/or deep drawing processes is fully developed. Surfaces are smooth and generally do not have grooves, folds or the like that are difficult to access.

Flexible packaging pouches however comprise a less smooth surface that can form transitions and undercuts due to the way in which they are made. Ridges, glued surfaces, and folded areas have to be accepted in the shaping of the pouches that result in areas such as grooves, folds, edges, and/or the like that are hard to reach for cleaning liquids.

For example, bags or pouches may be made in the form of a roll of individual bags or pouches that are attached at edges. In this respect, cleaning the whole roll of bags or pouches, while still wound in a roll, may be quite difficult with cleaning process of the prior art. In many cleaning methods of the prior art, it may be advantageous to unroll the wound roll of pouches or bags and to even open the bags or pouches so that most all of the surface of the bags or pouches are exposed to a cleaning material. Disposing the individual bags or pouches for cleaning may increase costs and time associated with the cleaning and filling of the bags or pouches.

Thermal treatment of the filled pouch is undesirable for many liquids and products that are commercially packaged in flexible pouches because such treatment results in impaired product quality. There is therefore a great interest in cold aseptic filling. In addition to known cleaning steps in water, vapor, or sterilizing liquids, sterilization with hydrogen peroxide is very common in industrial filling machines for beverages.

Even though this system works reliably in principle, the degree of wetting the surface to be sterilized in as short a time as possible is limited, and an increase in throughput speed at even lower germ counts cannot be achieved with this system or would require and/or desire an unjustifiably great effort and expense.

Another known method is to sterilize the packaging or film material used for producing packaging pouches and to produce these pouches in a sterile room or clean room. Some methods propose to conduct the film material in a first step through a wet cleaning station and then move the film cleaned in this way past a UV light source to achieve the desired killing of germs.

Some methods with the pre-cleaning in the first step may also be performed using a suitable liquid bath. Downstream of this first treatment step, the film is directed upwards in a shaft so that the liquid can run off, and suitable wipers of the other drying devices are positioned upstream of the UV lamp. This wet and partially mechanized cleaning step is required and/or desired to achieve substantial germ removal in a first step since UV irradiation alone is not sufficient, for example when the film material runs at high speeds. This wet mechanical treatment of the films is costly and may result in deterioration of the product due to incomplete removal of residual liquid and incomplete drying. In addition, UV irradiation does not result in the required and/or desired degree of sterilization in many cases including packaging pouches, for example when such pouches are hard to reach for UV radiation or comprise insufficiently accessible areas and/or comprise a material not transparent to UV light or with reduced UV permeability, such as multi-layer materials with one or more diffusion barrier layers.

Further, an apparatus is known for sterilizing products by high-pressure treatment, that is, applying a high pressure to sides or surfaces of the product, e.g. a process pressure in the range of 4,000 bars. This known apparatus that mainly comprises a high-pressure vessel that can be closed and to which the high process pressure can be applied, is for example intended for the treatment of food products.

OBJECT OR OBJECTS

It is the object of the present application to provide a plant that can be used for packaging products using packages with a high degree of cleaning.

SUMMARY

To achieve this object, the present application discloses a system for the sterile packaging of products in a package, with at least one packing station in a sterile chamber into which the respective package and/or a raw material for packaging is fed via a feed lock with a sterilization device. The sterilization device is designed for the sterilization of the package and/or the raw material for packaging by a high-pressure treatment. Also disclosed is a method for the sterile packaging of products in a clean room with at least one feed lock equipped with a sterilization device via which the package used for packaging and/or the raw material for packaging used is introduced into the clean room after being sterilized in the sterilization device. The package and/or the raw material for packaging is/are sterilized in a pressure medium by applying high pressure.

Using the system according to the present application, a high degree of sterilization (extremely low residual germ count) is achieved for the raw material for packaging or packages used and thus for the product produced there. This applies in one possible embodiment to such packages as packaging pouches that are inaccessible for the liquid and/or gaseous sterilization media and/or UV light used in typical cleaning or sterilization methods or that comprise areas hard to reach for these media.

The design according to the present application allows complete sterilization of surfaces of the respective package or raw material for packaging, in at least one possible embodiment of packaging pouches or other three-dimensional or bulky packages in areas both inside and outside.

Improvements, embodiments, and applications of the present application can be derived from the description of embodiments given below and from the figures. The characteristics described and/or depicted graphically are in themselves or in any combination the subject matter of the present application.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application will be described in greater detail below with reference to FIGS. 1 and 2, both showing a simplified diagrammatic view of a sterilization device for packages together with facilities for processing these packages. A system and method of the present disclosure will be described with reference to FIG. 3, showing a block diagram of a system for cleaning packaging.

DESCRIPTION OF EMBODIMENT OR EMBODIMENTS

Figure 1:
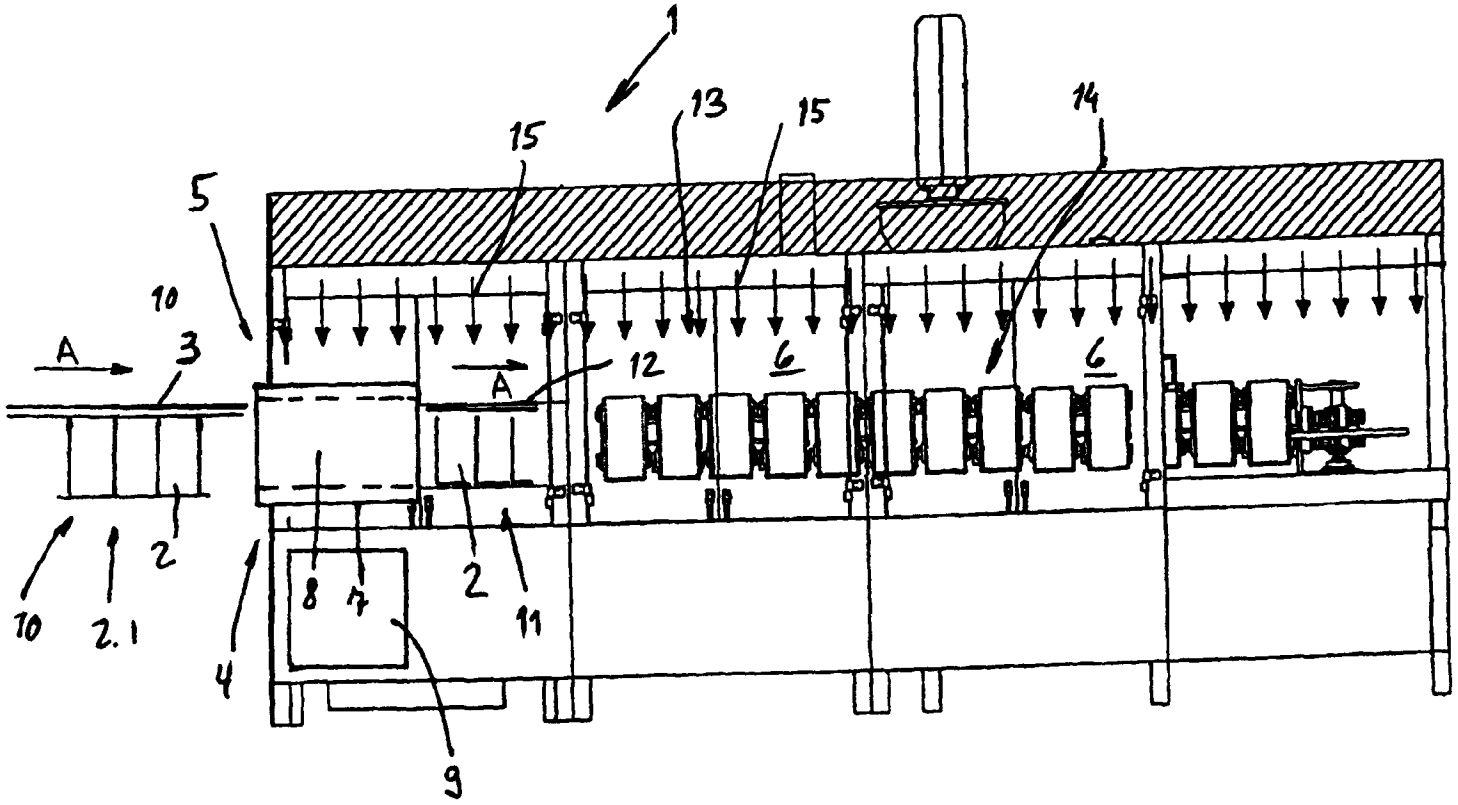

The system generally referenced with 1 in FIG. 1 is used for the sterile filling and closing of packages in the form of packaging pouches 2. The packaging pouches 2 that are made, for example, of one- or multiple-ply plastic film are fed into the system 1 or a sterilization device 4 of this system, respectively, via a suitable external conveyor 3, for example as a continuous packaging pouch strand 2.1 in which the packaging pouches 2 are connected by material sections including, for example, perforated material sections.

Various terms are used in the present disclosure, some may be defined elsewhere in this disclosure and some may not. If a term is defined elsewhere, then the broader definition shall be considered.

"Packaging" in the meaning of the present application is any type of packaging products in packages, for example the filling of packages such as pouches with the product and the subsequent closing of the filled packages.

"Package" in the meaning of the present application designates packagings of the most varied type and/or elements thereof such as containers, seals, or caps, and for example packaging pouches.

"Raw material for packaging" in the meaning of the present application is the semi-finished product used for manufacturing or forming the packages, for example flats (films), for example in rolled-up form.

"Germs" in the meaning of the present application are microorganisms of any kind such as bacteria, viruses, fungi, etc.

The sterilization device 4 is part of a feed lock 5 that separates the sterile interior chamber or clean room 6 of the system 1 from the external environment and generally comprises a high-pressure vessel 7 that can be closed on both sides and in which the packaging pouches 2 are sterilized at high pressure, i.e. at a process pressure P that may be in the range from 3,000 to 7,000 bars. The high-pressure vessel 7 may have an inner diameter of up to 500 millimeters and a length in the range from 3,000 millimeters to 4,000 millimeters. A typical inner diameter is in the range from 300 millimeters to 400 millimeters.

For this pressure treatment, the closed interior chamber 8 of the high-pressure vessel 7 is filled with a pressure-transferring medium (hereinafter also called "pressure medium") which is in a liquid state at least under the process pressure P and completely fills the interior chamber 8 of the high-pressure vessel 7. In at least one possible embodiment of the present application, a suitable pressure medium is an incompressible medium that is also in a liquid state at ambient pressure, such as sterile water or pure water. In principle, sterile gases that are in a liquid state at the process pressure P such as air, $CO_2$, nitrogen, or inert gases are also generally suited as pressure media. Inert behavior of the gases towards the packages is of decisive importance here. In at least one possible embodiment of the present application involving using liquid gases, the adhering pressure medium will completely convert into gaseous state due to the pressure drop, and the packaging materials can be removed in dry condition without requiring a special drying step.

The packaging pouches 2 can be treated at high pressure in areas due to the pressure medium that is in liquid state at least at the process pressure and completely fills the high-pressure vessel 7 or its interior chamber 8, respectively. The pressure medium and the process pressure are provided by a pressure generator or pressure source 9.

In the embodiment shown in FIG. 1, the packaging pouches 2 are introduced as a group of multiple packaging pouches 2 into a holding/handling device that is attached to a feeding station 10. The high-pressure vessel 7 is open towards the outer side of the system 1 for this purpose but closed towards the clean room 6. The pressure treatment during which existing germs are killed by the process pressure P on surfaces of the packaging pouches 2, i.e. in one possible embodiment on inner and outer surfaces, ridges, glued areas, folds and other hard-to-reach areas, is performed thereafter while the high-pressure vessel 7 is completely sealed.

During the high-pressure treatment, the high-pressure vessel 7 is mounted in a yoke not shown here to absorb the forces that act onto the locking elements. Two known variants can generally be applied. Either a) The high-pressure vessel is mounted rigidly and the yoke is pivoted in front of the locking elements or b) The high-pressure vessel 7 is moved out of the yoke and into the conveyor line that in one possible embodiment runs in parallel or substantially parallel to the yoke.

After completing the pressure treatment and relieving the high-pressure vessel 7, the vessel is opened towards the clean room 6 of the system 1 and the sterilized packaging pouches 2, once again as a group 2.1, are taken out of the high-pressure vessel 7 at a removal station 11 using a suitable holding/handling device and transferred to the system-internal conveyor 12 that takes the packaging pouches 2 first to the filling stations 13 also located in the clean room 6 for filling and then to the closing stations 14 (arrow A). The filled and closed packaging pouches 2 leave the system 1 via another lock not shown here.

After the treated packaging pouches 2 are removed from the high-pressure vessel 7, the vessel is once again closed towards the clean room 6 and then opened towards the environment or the conveyor 3 for receiving other packaging pouches 2 to be treated.

To essentially ensure or promote the required and/or desired degree of sterilization in the clean room 6 of the system 1, the clean room is constantly or substantially constantly ventilated with sterile air using the atmospheric pressure as shown by the arrows 15. The removal station 11 is at the same time used for drying the packaging pouches 2 after the pressure treatment, i.e. for removing residual pressure medium from these pouches by treating them with a sterile air or gas stream as is also indicated by the arrows 15.

The packaging pouches 2 may for example be produced from a film unreeled from a supply roll by a folding and forming machine not shown in FIG. 1.

Figure 2:
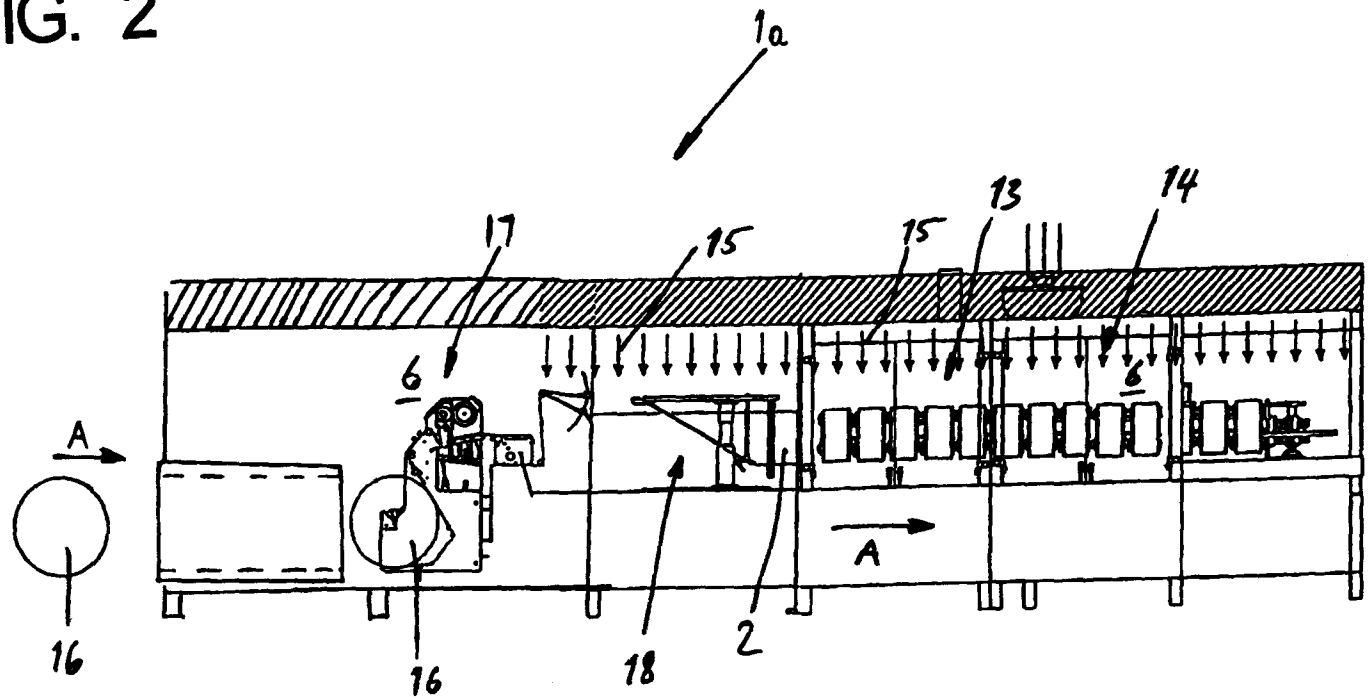

FIG. 2 is a very simplified representation of a system 1*a* in which the packaging pouches 2 are formed inside the sterile clean room 6 using a previously sterilized supply roll 16 of the raw material for packaging used for producing the packaging pouches 2, for example film material. The system 1*a* once again comprises a feed lock 5 formed by the high-pressure vessel 7 that is used for sterilization or pressure treatment of the entire supply roll 16. The supply roll is fed into the interior chamber of the high-pressure vessel 7 while the vessel is open towards the outside of the system 1*a*. Then the high-pressure vessel 7 is closed and the entire supply roll 16 is pressure-treated using the pressure medium introduced into the vessel that is liquid at least at the process pressure P of the pressure treatment.

The entire supply roll 16 is fed into the high-pressure vessel 7 when it is open towards the environment and closed towards the clean room 6*a* of the system 1*a*and sterilized by high-pressure treatment using the pressure medium after closing the high-pressure vessel. After this treatment, the pressure-relieved high-pressure vessel 7 is opened towards the clean room 6, and the supply roll 16 is placed into a feeding device 17 in the clean room 6 using a manipulator also located in the clean room 6 and not shown here. The flat material used to form the packaging pouches 2 is then continuously or substantially continuously reeled off from this feeding device 17 and formed into packaging pouches at a folding and forming station 18 also located in the clean room 6, and said pouches are subsequently filled and closed at the filling and closing stations 13 and 14 and leave the system 1*a* at another lock not shown here.

The treatment result can optionally be further improved and/or the treatment time considerably reduced by using a pressure medium that is incompressible and liquid at least during the pressure treatment, for example by using pure water at a temperature in the range from thirty to sixty degrees Celsius.

The present application has been described above with reference to embodiments. It is understood that numerous changes and modifications are conceivable without departing from the teaching idea the present application is based upon.

The present application has been described above in conjunction with the sterilization of ready-made packaging pouches 2 or the sterilization of supply rolls 16 of the flat material used for producing such pouches. The sterilization device 4 can in principle also be used for sterilizing other packages such as bulky containers, caps, other container lids, etc.

The packaging may comprises multiple parts and include caps or any kind of lids, spouts, shoulder, etc. In one variant of the method, the packaging material includes molded parts such as lock elements, spouts, shoulder elements and the like. These can be treated alone or together with other packaging materials using the method described. In a method in which the various components are treated separately, it is useful to provide separate high-pressure vessels for each group of packaging components, in at least one possible embodiment for flats and lids or shoulder parts, and to adjust the process parameters in a suitable way to the materials of the respective group of packaging components.

In one variant of the method, the molded parts mentioned above are sterilized using the high-pressure step while the flat material or the pouch is sterilized using a thermal and/or chemical sterilization method.

The present application relates to a system for the sterile packaging of products in packages, having at least one packing station 13, 14 in a sterile interior system chamber into which the packages 2 are fed through at least one sterilization device 4 serving as an feed lock 5, the sterilization device 4 being designed for sterilizing the package 2 by means of a high-pressure treatment.

Figure 3:
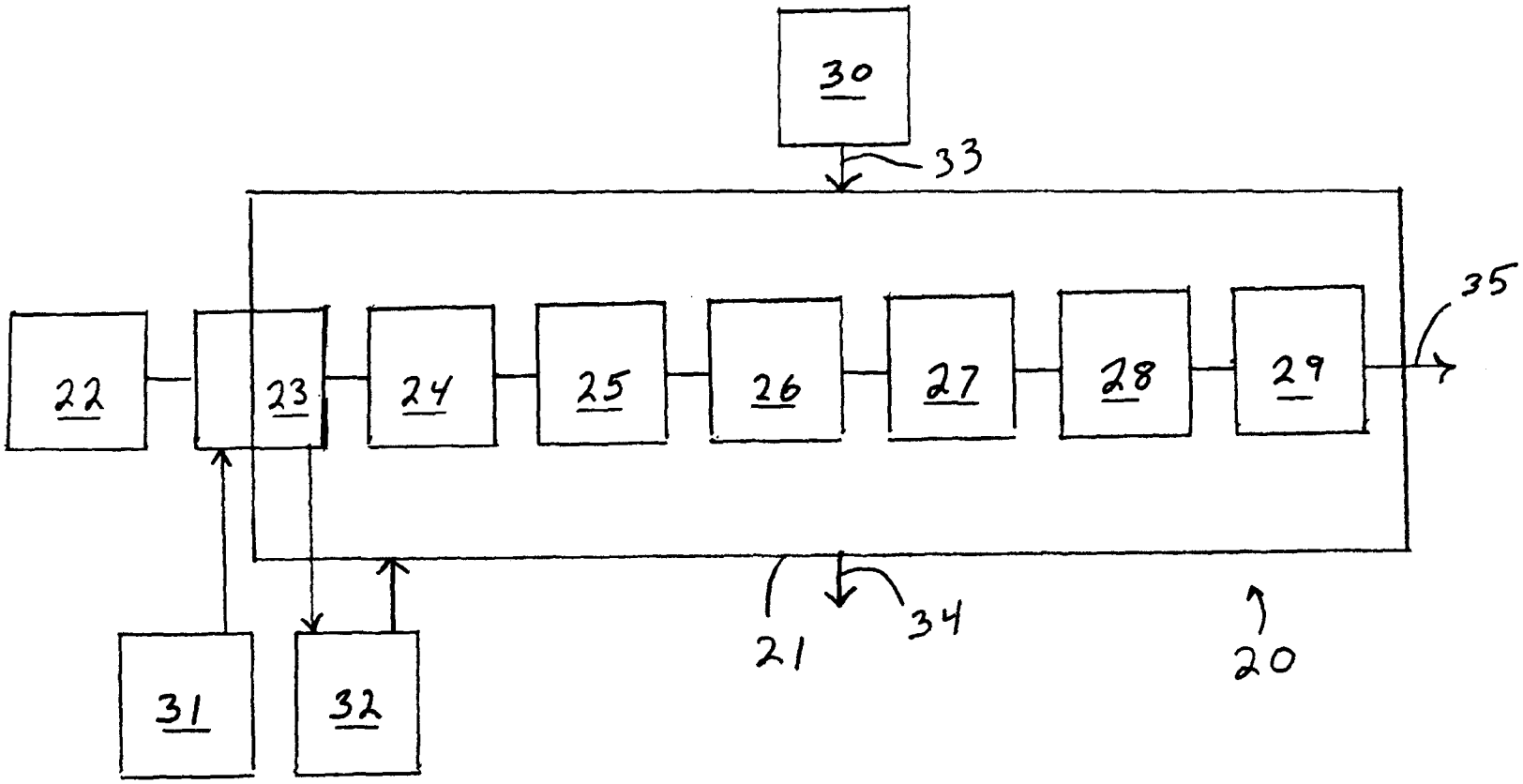

FIG. 3 shows a block diagram of a system 20 for cleaning packaging. Cleaning may comprise disinfecting, sterilizing, or inhibiting the reproductive capabilities of microorganisms deposited in a pressure chamber with packaging. The term microorganisms is used broadly to include viruses, germs, microbes, bacteria, fungi, amoeba, protozoa, and other minute organisms. In at least one embodiment, packaging system 20 provides a system configured to sterilize packaging for packaging filling material sensitive to microorganisms and maximizing the shelf life of the filling material.

An opening and disposing arrangement 22 is configured to open a pressure chamber 23 to a non-sterile ambient environment to receive packaging material and to dispose the packaging material in the pressure chamber 23. Opening and disposing arrangement may comprise an automatic door opener, grippers, conveyors, and other means for opening pressure chamber 23 and other means for disposing packaging material in the pressure chamber 23. Opening and disposing arrangement 22 may also be configured to close and seal the pressure chamber 23 upon disposing of packaging material within pressure chamber 23.

Pressurizing arrangement 31 is configured to pressurize the pressure chamber 23 with at least a pressure sufficient to at least inhibit reproductive capabilities of microorganisms deposited in the pressure chamber with the packaging material. In at least one embodiment, pressurizing arrangement 31 comprises a high pressure pump configured to pressurize a gas or liquid up to between 3,000 bars (43511 psi) and 7,000 bars (101526 psi), or even higher. For example, high pressure pumps such as Li'1CRITTER™, FC SERIES™, and FLEXI-POWER™ pumps, manufactured by Hydro-Pac Inc., may be used. Other and different means for pressurizing the pressure chamber 23 with at least a pressure sufficient to at least inhibit reproductive capabilities of microorganisms deposited in the pressure chamber 23 with the packaging material may be used.

Pressure chamber 23 is configured to hold at least a pressure sufficient to at least inhibit reproductive capabilities of microorganisms deposited in the pressure chamber with the packaging material. In at least one embodiment, pressure chamber or vessel 23 is configured to hold a pressurized gas or liquid up to between 3,000 bars (43511 psi) and 7,000 bars (101526 psi), or even higher. For example, pressure vessels manufactured by Harwood Engineering Company may be used. In at least one additional embodiment, pressure chamber 23 is configured to contain the pressurized gas or liquid at a temperature up to 60 degrees Celsius. In at least one additional embodiment, pressure chamber 23 is configured to pressurize packaging comprising at least one of caps, lids, screw tops, lock elements, spouts, shoulder elements, containers, bulky containers, seals, bags, and pouches. In a further embodiment, packaging system 20 may comprise two or more pressure chambers 23.

Pressure reducing arrangement 32 is configured to reduce the pressure in the pressure chamber 23 to at least substantially ambient pressure. In at least one embodiment, pressure reducing arrangement 32 may release a portion of pressurizing material in the pressure chamber 23 into the sterile chamber 21. Pressure reducing arrangement 32 may comprise a valve or other means for reducing the pressure in the pressure chamber to at least substantially ambient pressure. Pressure reducing arrangement 32 may be configured to reduce the pressure of pressure chamber 23 upon being pressurized for fractions of a second, a second, seconds in one second increments, fractions of a minute, a minute, minutes in one minute increments, and on up.

An opening arrangement 24 is configured to open the pressure chamber 23 into a sterile chamber 21. Opening arrangement 24 may be any means as is known in the art for opening the pressure chamber 23. A moving arrangement 25 is configured to move the packaging material out of the pressure chamber into a filling station, in the sterile chamber 21. Moving arrangement 25 may comprise grippers, conveyors, and other means for moving the packaging material out of the pressure chamber 23 into a filling station, in the sterile chamber 21.

A disposing arrangement 26 is provided in sterile chamber 21. Disposing arrangement 26 is configured to dispose the packaging material as packages configured to receive the filling material sensitive to microorganisms. Any means for disposing the packaging material as packages, as is known in the art, for receiving filling material may be used.

A ventilating arrangement 30 is configured to ventilate the sterile chamber 21 with a substantially sterile gas. Ventilating arrangement 30 may comprise a fan configured move a sterile gas, such as sterile air, into sterile chamber 21. For example, a sterile gas may be forced into sterile chamber 21 as indicated by arrow 33 and out of sterile chamber 21 as indicated by arrow 34. Ventilating arrangement 30 may comprise other means for ventilating the sterile chamber 21 with a substantially sterile gas.

A filling arrangement 27, in the sterile chamber 21, is configured to fill the packages with the filling material, in the sterile chamber. The filling material may comprise food stuff, liquids or solids, such as chips, potato chips, soup, dried fruit, dehydrated vegetables such as peas and carrots, drinks, sterilized milk, and ultra pasturized milk, for example. Any means for filling the packages, as is known in the art may be used for filling the packages with the filling material.

A feeding arrangement 28 configured to feed the filled packages to a closing station, in the sterile chamber 21, is provided. Feeding arrangement 28 may comprise grippers, conveyors, and other means for feeding the filled packages to a closing station in the sterile chamber 21.

A sealing arrangement 29, in the sterile chamber 21, is configured to seal the packages containing the filling material sensitive to microorganisms. Sealing arrangement 29 may comprise a heat sealer or other means for sealing, as is known in the art, the packages containing the filling material sensitive to microorganisms. Moving arrangement 35 is configured to move the sealed packages out of the sterile chamber.

One feature or aspect of an embodiment is believed at the time of the filing of this patent application to possibly reside broadly in a system for the sterile packaging of products in a package, with at least one packing station 13, 14 in a sterile chamber into which the respective package 2 and/or a raw material for packaging 16 is fed via a feed lock 5 with a sterilization device 4, wherein the sterilization device 4 is designed for the sterilization of the package 2 and/or the raw material for packaging 16 by a high-pressure treatment.

Another feature or aspect of an embodiment is believed at the time of the filing of this patent application to possibly reside broadly in the system, wherein the at least one sterilization device 4 is formed by a closable high-pressure vessel 7 in which the package 2 and/or the raw material for packaging 16 is/are treated at the process pressure P using a liquid treatment or pressure medium.

Yet another feature or aspect of an embodiment is believed at the time of the filing of this patent application to possibly reside broadly in the system, wherein the pressure medium is a sterile liquid such as sterile water or pure water.

Still another feature or aspect of an embodiment is believed at the time of the filing of this patent application to possibly reside broadly in the system, wherein the pressure medium is a gaseous medium such as air, nitrogen, $CO_2$, or inert gas that is at least liquefied at the process pressure P.

A further feature or aspect of an embodiment is believed at the time of the filing of this patent application to possibly reside broadly in the system, wherein the high-pressure vessel 7 comprises at least one first closable opening on a non-sterile outer side of the feed lock 5 for introducing the package 2 and/or the raw material for packaging 16 to be treated.

Another feature or aspect of an embodiment is believed at the time of the filing of this patent application to possibly reside broadly in the system, wherein the high-pressure vessel 7 comprises at least one second closable opening on the sterile side of the feed lock 5 for discharging the treated package 2 and/or the treated raw material for packaging 16.

Yet another feature or aspect of an embodiment is believed at the time of the filing of this patent application to possibly reside broadly in the system, comprising control means for the opposite opening and closing of the high-pressure vessels 7.

Still another feature or aspect of an embodiment is believed at the time of the filing of this patent application to possibly reside broadly in the system, wherein the packages fed into the clean room 6 via the feed lock 5 are packaging pouches 2.

A further feature or aspect of an embodiment is believed at the time of the filing of this patent application to possibly reside broadly in the system, wherein the raw material for packaging 16 fed into the clean room 6 is a flat material wound up into a roll.

Another feature or aspect of an embodiment is believed at the time of the filing of this patent application to possibly reside broadly in the system, wherein a station 11 for removing the pressure medium from the package, e.g. a blow-off station, is provided in the feeding direction of the package and/or the raw material for packaging 16 in the clean room 6 downstream of the feed lock 5 or the sterilization device 4, respectively.

Yet another feature or aspect of an embodiment is believed at the time of the filing of this patent application to possibly reside broadly in the system, wherein the at least one high-pressure vessel 7, 7*a* is designed for a pressure treatment at a process pressure P in the range from 3,000 to 7,000 bars.

Still another feature or aspect of an embodiment is believed at the time of the filing of this patent application to possibly reside broadly in the system, wherein at least one filling station 13 with a closing station 14 is provided as a packing station in the clean room 6.

A further feature or aspect of an embodiment is believed at the time of the filing of this patent application to possibly reside broadly in the system, wherein at least one feeding device 17 for receiving a supply roll 16 of a flat material used as package or for producing the package 2 that is introduced via the feed lock 5 is provided in the clean room 6.

One feature or aspect of an embodiment is believed at the time of the filing of this patent application to possibly reside broadly in the system, comprising at least one folding and forming station 18 located in the clean room 6 for forming the package 2 from the raw material for packaging 16.

Another feature or aspect of an embodiment is believed at the time of the filing of this patent application to possibly reside broadly in a method for the sterile packaging of products in a clean room 6 with at least one feed lock 5 equipped with a sterilization device 4 via which the package used for packaging and/or the raw material for packaging used is introduced into the clean room 6 after being sterilized in the sterilization device 4, wherein the package 2 and/or the raw material for packaging 16 is/are sterilized in a pressure medium by applying high pressure.

Yet another feature or aspect of an embodiment is believed at the time of the filing of this patent application to possibly reside broadly in the method, wherein the pressure treatment is performed at a process pressure in the range between 3,000 and 7,000 bars.

Still another feature or aspect of an embodiment is believed at the time of the filing of this patent application to possibly reside broadly in the method, wherein the pressure medium is a liquid medium such as sterile water or pure water.

A further feature or aspect of an embodiment is believed at the time of the filing of this patent application to possibly reside broadly in the method, wherein the pressure medium is a gaseous medium such as air, nitrogen, $CO_2$, or inert gas that is at least liquefied at the process pressure.

Another feature or aspect of an embodiment is believed at the time of the filing of this patent application to possibly reside broadly in the method, wherein the packages are pouches, for example pouches made of a flat material.

Yet another feature or aspect of an embodiment is believed at the time of the filing of this patent application to possibly reside broadly in the method, wherein the raw material for packaging is a flat material, in one possible embodiment a flat material wound up into a roll 16.

Still another feature or aspect of an embodiment is believed at the time of the filing of this patent application to possibly reside broadly in the method, wherein the treatment is performed in a high-pressure vessel 7.

A further feature or aspect of an embodiment is believed at the time of the filing of this patent application to possibly reside broadly in the method, wherein the treatment is performed using a heated pressure medium.

Another feature or aspect of an embodiment is believed at the time of the filing of this patent application to possibly reside broadly in the method, wherein the package includes molded parts such as lock elements, caps, lids, screw tops, spouts, shoulder elements and the like.

Yet another feature or aspect of an embodiment is believed at the time of the filing of this patent application to possibly reside broadly in the method, wherein one group of parts of the packaging materials is treated using the method described.

Still another feature or aspect of an embodiment is believed at the time of the filing of this patent application to possibly reside broadly in the method, wherein the treatment for different groups of packaging parts is performed in separate high-pressure vessels 7.

A further feature or aspect of an embodiment is believed at the time of the filing of this patent application to possibly reside broadly in the method, wherein the treatment for different groups of packaging parts in high-pressure vessels 7 is not performed for groups of packaging parts.

Another feature or aspect of an embodiment is believed at the time of the filing of this patent application to possibly reside broadly in a method of preparing and filling packaging, the method comprising the steps of:

disposing packaging in a pressure chamber;

closing and sealing the packaging within the pressure chamber;

cleaning the packaging essentially solely by pressurizing the pressure chamber;

reducing the pressure within the pressure chamber;

opening the pressure chamber into a clean chamber;

moving the packaging into the clean chamber;

disposing the packaging as packages configured to receive a filling material, in the clean chamber;

filling the packages with the filling material, in the clean chamber;

feeding the filled packages to a closing station, in the clean chamber;

sealing the packages in the clean chamber; and moving the sealed packages from the clean chamber.

Yet another feature or aspect of an embodiment is believed at the time of the filing of this patent application to possibly reside broadly in a method of preparing and filling packaging, wherein the step of disposing packaging in a pressure chamber is preceded by a step of opening the pressure chamber to a non-sterile ambient environment.

One feature or aspect of an embodiment is believed at the time of the filing of this patent application to possibly reside broadly in a method of preparing and filling packaging wherein the step of reducing the pressure within the pressure chamber comprises releasing a portion of pressurizing material in the pressure chamber into the clean chamber.

Another feature or aspect of an embodiment is believed at the time of the filing of this patent application to possibly reside broadly in a method of preparing and filling packaging, wherein the step of cleaning the packaging comprises sterilizing the packaging and comprises pressurizing the pressure chamber to a pressure in a range from 3,000 to 7,000 bars.

Yet another feature or aspect of an embodiment is believed at the time of the filing of this patent application to possibly reside broadly in a method of preparing and filling packaging, wherein said step of cleaning the packaging comprises heating the pressurizing material.

Still another feature or aspect of an embodiment is believed at the time of the filing of this patent application to possibly reside broadly in a method of preparing and filling packaging, wherein the step of disposing packaging in a pressure chamber comprises disposing a roll of flat packaging in the pressure chamber and the step of disposing the packaging as packages configured to receive a filling material comprises forming packages from the roll of flat packaging.

A further feature or aspect of an embodiment is believed at the time of the filing of this patent application to possibly reside broadly in a method of preparing and filling packaging, wherein the step of disposing packaging in a pressure chamber comprises disposing pouches configured to receive a filling material and the step of disposing the packaging as packages configured to receive a filling material comprises opening and disposing the pouches to be filled with the filling material.

Another feature or aspect of an embodiment is believed at the time of the filing of this patent application to possibly reside broadly in a method of preparing and filling packaging, the method further comprising one of the following:

a) wherein the pressure chamber has a liquid material contained therein, said step of cleaning the packaging comprises pressurizing the pressure chamber by pressurizing the liquid material in the pressure chamber;

b) wherein the pressure chamber has a sterile liquid material contained therein, said step of cleaning the packaging comprises pressurizing the pressure chamber by pressurizing the sterile liquid material in the pressure chamber;

c) wherein the pressure chamber has a sterile water contained therein, said step of cleaning the packaging comprises pressurizing the pressure chamber by pressurizing the sterile water in the pressure chamber;

d) wherein the pressure chamber has a gaseous material contained therein, said step of cleaning comprises sterilizing the packaging and comprises pressurizing the pressure chamber by pressurizing the gaseous material in the pressure chamber to at least liquify a portion of the gaseous material in the pressure chamber;

e) wherein the packaging disposed in the pressure chamber comprises a roll of wound packaging material;

f) wherein the packaging additionally comprises at least one of caps, lids, screw tops, lock elements, spouts, shoulder elements, containers, bulky containers, seals, and pouches;

g) wherein the packaging additionally comprises at least one of caps, lids, screw tops, lock elements, spouts, shoulder elements, containers, bulky containers, seals, and pouches and at least a portion of the packaging is not cleaned; and h) wherein the packaging additionally comprises at least one of caps, lids, screw tops, lock elements, spouts, shoulder elements, containers, bulky containers, seals, and pouches and wherein a first portion of the packaging is cleaned in a first pressure chamber and a second portion of the packaging is cleaned in a second pressure chamber.

Yet another feature or aspect of an embodiment is believed at the time of the filing of this patent application to possibly reside broadly in a method of preparing and filling packaging, the method further comprising all of the following:

a) wherein the step of disposing packaging in a pressure chamber is preceded by a step of opening the pressure chamber to a non-sterile ambient environment;

b) wherein the step of reducing the pressure within the pressure chamber comprises releasing a portion of pressurizing material in the pressure chamber into the clean chamber;

c) wherein the step of cleaning the packaging comprises sterilizing the packaging and comprises pressurizing the pressure chamber to a pressure in a range from 3,000 to 7,000 bars;

d) wherein said step of cleaning the packaging comprises heating the pressurizing material;

e) wherein the pressure chamber has a liquid material, sterile liquid material, or sterile water contained therein, said step of cleaning the packaging comprises pressurizing the pressure chamber by pressurizing the liquid material, sterile liquid material, or sterile water in the pressure chamber, or, wherein the pressure chamber has a gaseous material contained therein, said step of cleaning comprises sterilizing the packaging and comprises pressurizing the pressure chamber by pressurizing the gaseous material in the pressure chamber to at least liquify a portion of the gaseous material in the pressure chamber;

f) wherein the packaging disposed in the pressure chamber comprises a roll of wound packaging material;

g) wherein the packaging disposed in the pressure chamber comprises a roll of wound packaging material and the packaging additionally comprises at least one of caps, lids, screw tops, lock elements, spouts, shoulder elements, containers, bulky containers, seals, and pouches;

h) wherein at least a portion of the packaging is not cleaned; and

I) wherein a first portion of the packaging is cleaned in a first pressure chamber and a second portion of the packaging is cleaned in a second pressure chamber.

Still another feature or aspect of an embodiment is believed at the time of the filing of this patent application to possibly reside broadly in a packaging system configured to prepare and fill packaging, the packaging system comprising:

a disposing arrangement configured to dispose packaging in a pressure chamber;

a closing and sealing arrangement configured to close and seal the packaging within the pressure chamber;

a cleaning arrangement configured to clean packaging essentially solely by pressurizing the pressure chamber;

a pressure reducing arrangement configured to reduce the pressure within the pressure chamber;

an opening arrangement configured to open the pressure chamber into a clean chamber;

a moving arrangement configured to move the packaging into the clean chamber;

a disposing arrangement configured to dispose the packaging as packages configured to receive a filling material, in the clean chamber;

a filling arrangement configured to fill the packages with the filling material, in the clean chamber;

a feeding arrangement configured to feed the filled packages to a closing station, in the clean chamber;

a sealing arrangement configured to seal the packages in the clean chamber; and a moving arrangement configured to move the sealed packages from the clean chamber.

A further feature or aspect of an embodiment is believed at the time of the filing of this patent application to possibly reside broadly in means for preparing and filling packaging, said means comprising:

means for disposing packaging in a pressure chamber;

means for closing and sealing the packaging within the pressure chamber;

means for cleaning the packaging essentially solely by pressurizing the pressure chamber;

means for reducing the pressure within the pressure chamber;

means for opening the pressure chamber into a clean chamber;

means for moving the packaging into the clean chamber;

means for disposing the packaging as packages configured to receive a filling material, in the clean chamber;

means for filling the packages with the filling material, in the clean chamber;

means for feeding the filled packages to a closing station, in the clean chamber;

means for sealing the packages in the clean chamber; and means for moving the sealed packages from the clean chamber.

Another feature or aspect of an embodiment is believed at the time of the filing of this patent application to possibly reside broadly in a method of sterile packaging of filling material sensitive to microorganisms and maximizing the shelf life of the filling material, the method comprising the steps of:

opening a pressure chamber to receive packaging material;

disposing the packaging material in the pressure chamber;

closing and sealing the pressure chamber;

pressurizing the pressure chamber with at least a pressure sufficient to at least inhibit reproductive capabilities of microorganisms deposited in the pressure chamber with the packaging material;

reducing the pressure in the pressure chamber to at least substantially ambient pressure;

opening the pressure chamber into a sterile chamber;

moving the packaging material out of the pressure chamber into a filling station in the sterile chamber;

in the sterile chamber, disposing the packaging material as packages configured to receive the filling material sensitive to microorganisms;

ventilating the sterile chamber with a substantially sterile gas;

in the sterile chamber, filling the packages with the filling material;

feeding the filled packages to a closing station in the sterile chamber;

in the sterile chamber, sealing the packages containing the filling material sensitive to microorganisms; and moving the sealed packages out of the sterile chamber.

Yet another feature or aspect of an embodiment is believed at the time of the filing of this patent application to possibly reside broadly in a packaging system configured to perform a method of sterile packaging of filling material sensitive to microorganisms and maximizing the shelf life of the filling material, the packaging system comprising:

an opening arrangement configured to open a pressure chamber to receive packaging material;

a disposing arrangement configured to dispose the packaging material in the pressure chamber;

a closing and sealing arrangement configured to close and seal the pressure chamber;

a pressurizing arrangement configured to pressurize the pressure chamber with at least a pressure sufficient to at least inhibit reproductive capabilities of microorganisms deposited in the pressure chamber with the packaging material;

a pressure reducing arrangement configured to reduce the pressure in the pressure chamber to at least substantially ambient pressure;

an opening arrangement configured to open the pressure chamber into a sterile chamber;

a moving arrangement configured to move the packaging material out of the pressure chamber into a filling station, in the sterile chamber;

a disposing arrangement, in the sterile chamber, configured to dispose the packaging material as packages configured to receive the filling material sensitive to microorganisms;

a ventilating arrangement configured to ventilate the sterile chamber with a substantially sterile gas;

a filling arrangement, in the sterile chamber, configured to fill the packages with the filling material;

a feeding arrangement configured to feed the filled packages to a closing station, in the sterile chamber;

a sealing arrangement, in the sterile chamber, configured to seal the packages containing the filling material sensitive to microorganisms; and a moving arrangement configured to move the sealed packages out of the sterile chamber.

One feature or aspect of an embodiment is believed at the time of the filing of this patent application to possibly reside broadly in means for sterile packaging of filling material sensitive to microorganisms and maximizing the shelf life of the filling material, said means comprising:

means for opening a pressure chamber to receive packaging material;

means for disposing the packaging material in the pressure chamber;

means for closing and sealing the pressure chamber;

means for pressurizing the pressure chamber with at least a pressure sufficient to at least inhibit reproductive capabilities of microorganisms deposited in the pressure chamber with the packaging material;

means for reducing the pressure in the pressure chamber to at least substantially ambient pressure;

means for opening the pressure chamber into a sterile chamber;

means for moving the packaging material out of the pressure chamber into a filling station, in the sterile chamber;

means for disposing the packaging material as packages, in the sterile chamber, the packages being configured to receive the filling material sensitive to microorganisms;

means for ventilating the sterile chamber with a substantially sterile gas;

means for filling the packages, in the sterile chamber, with the filling material;

means for feeding the filled packages to a closing station in the sterile chamber;

means for sealing, in the sterile chamber, the packages containing the filling material sensitive to microorganisms; and means for moving the sealed packages out of the sterile chamber.

Another feature or aspect of an embodiment is believed at the time of the filing of this patent application to possibly reside broadly in a method for sterile packaging of filling material sensitive to microorganisms and maximizing the shelf life of the filling material, further comprising all of the following:

a) wherein the step of disposing packaging in a pressure chamber is preceded by a step of opening the pressure chamber to a non-sterile ambient environment;

b) wherein the step of reducing the pressure within the pressure chamber comprises releasing a portion of pressurizing material in the pressure chamber into the sterile chamber;

c) wherein the step of pressurizing the pressure chamber comprises sterilizing the packaging and comprises pressurizing the pressure chamber to a pressure in a range from 3,000 to 7,000 bars;

d) wherein said step of pressurizing the pressure chamber comprises heating the pressurizing material;

e) wherein the pressure chamber has a liquid material, sterile liquid material, or sterile water contained therein, said step of pressurizing the pressure chamber comprises pressurizing the pressure chamber by pressurizing the liquid material, sterile liquid material, or sterile water in the pressure chamber, or, wherein the pressure chamber has a gaseous material contained therein, said step of pressurizing the pressure chamber comprises sterilizing the packaging and comprises pressurizing the pressure chamber by pressurizing the gaseous material in the pressure chamber to at least liquify a portion of the gaseous material in the pressure chamber;

f) wherein the packaging disposed in the pressure chamber comprises a roll of wound packaging material;

g) wherein the packaging additionally comprises at least one of caps, lids, screw tops, lock elements, spouts, shoulder elements, containers, bulky containers, seals, and pouches;

h) wherein at least a portion of the packaging is not cleaned; and

I) wherein a first portion of the packaging is cleaned in a first pressure chamber and a second portion of the packaging is cleaned in a second pressure chamber.

Yet another feature or aspect of an embodiment is believed at the time of the filing of this patent application to possibly reside broadly in a method for sterile packaging of filling material sensitive to microorganisms and maximizing the shelf life of the filling material wherein said filling material comprises food stuff.

Still another feature or aspect of an embodiment is believed at the time of the filing of this patent application to possibly reside broadly in a packaging system for sterile packaging of filling materials comprising:

a sterile chamber;

a pressure vessel having an inlet configured to receive packaging from outside the sterile chamber and an outlet configured to enable the packaging to move into the sterile chamber;

said pressure vessel being configured to sterilize the packaging essentially solely by pressurizing said pressure vessel;

a moving arrangement configured to move the packaging out of the pressure vessel and into the sterile chamber;

a disposing arrangement configured to dispose the packaging as packages configured to receive a filling material, in the sterile chamber;

a filling arrangement configured to fill the packages with the filling material, in the sterile chamber;

a closing and sealing arrangement configured to close and seal the packages, in the sterile chamber; and a moving arrangement configured to move the sealed packages from the sterile chamber.

A further feature or aspect of an embodiment is believed at the time of the filing of this patent application to possibly reside broadly in a packaging system for sterile packaging of filling materials further comprising a pressurizing arrangement disposed and configured to pressurize said pressure vessel by pressurizing a liquid or gaseous pressurizing material in said pressure vessel.

Another feature or aspect of an embodiment is believed at the time of the filing of this patent application to possibly reside broadly in a packaging system for sterile packaging of filling materials further comprising a pressure releasing arrangement disposed and configured to release a portion of the pressurizing material from said pressure vessel into said sterile chamber.

Yet another feature or aspect of an embodiment is believed at the time of the filing of this patent application to possibly reside broadly in a packaging system for sterile packaging of filling materials further comprising all of:

a) wherein said pressure vessel is disposed and configured to open to a non-sterile ambient environment to receive packaging;

b) wherein said pressure vessel is disposed and configured to release a portion of pressurizing material in the pressure vessel into the sterile chamber;

c) wherein the pressure vessel is configured to pressurize to a pressure in a range from 3,000 to 7,000 bars;

d) wherein said pressure vessel is configured to contain heated pressurizing material;

e) wherein the pressure vessel is configured to contain a liquid material, sterile liquid material, or sterile water, or, wherein the pressure vessel is configured to contain a gaseous material therein and to pressurize the gaseous material to at least liquify a portion of the gaseous material in the pressure vessel;

f) wherein the pressure vessel is configured to dispose packaging therein in the form of a roll of wound packaging material;

g) wherein the pressure vessel is configured to dispose additional packaging comprising at least one of caps, lids, screw tops, lock elements, spouts, shoulder elements, containers, bulky containers, seals, and pouches; and h) wherein said packaging system comprises a first pressure vessel disposed and configured to sterilize a first portion of the packaging and a second pressure vessel configured to sterilize a second portion of the packaging.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Jun. 23, 2008, and/or cited elsewhere are hereby incorporated by reference as if set forth in their entirety herein as follows: WO 03/003845, having the title "PROCESS FOR PASTEURIZING CHEESE PRODUCTS, AND CHEESE PRODUCTS FORMED THEREBY," published on Jan. 16, 2003; EP 0 312 022, having the following English translation of the German title "METHOD FOR STERILIZING HEAT-TOLERATING CONTAINERS UNDER CLEAN-ROOM CONDITIONS," published on Apr. 19, 1989; WO 2005/120960, having the title "DEVICE FOR THE SHAPING, FILLING AND SEALING OF CONTAINERS OF FLEXIBLE AND SOFT LAMINAR MATERIAL," published on Dec. 22, 2005; EP 0 206 096, having the following English translation of the German title "ISOLATION METHOD AND APPARATUS FOR STERILIZING CHAMBERS OF FILLING MACHINES," published on Dec. 30, 1986; U.S. Pat. No. 3,783,581, having the title "ASEPTIC PACKAGING METHOD AND MACHINE," published on Jan. 8, 1974; US 2005/123435, having the title "METHOD AND APPARATUS FOR CONTINUOUS PROCESSING OF PACKAGED PRODUCTS," published on Jun. 9, 2005; and FR 2,818,615, having the following English translation of the French title "Bottle filling installation, for products which may be degraded by oxygen, comprises cleaning-filling-sealing units contained inside compartment partially filled with inert gas," published on Jun. 28, 2002.

The patents, patent applications, patent publications, and other publications listed herein are incorporated by reference in their entirety herein, except words relating to the opinions and judgments of the author and not directly relating to the technical details of the description of the embodiments therein are not incorporated by reference. The purpose of incorporating U.S. patents, Foreign patents, patent publications, and other publications is solely to provide additional information relating to technical features of one or more embodiments, which information may not be completely disclosed in the wording in the pages of this application. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not to be incorporated by reference herein.

Some examples of methods and apparatuses for preparing and filling packaging that may possibly be utilized or adapted for use in at least one possible embodiment may possibly be found in the following U.S. patent applications: Ser. No. 12,388,083, filed Feb. 18, 2009, by Thomas Matheyka; Ser. No. 12,341,564, filed Dec. 22, 2008, by Thomas Matheyka; and Ser. No. 12,342,440, filed Dec. 23, 2008, by Thomas Matheyka.

Some examples of methods and apparatuses for moving, feeding, or disposing packaging that may possibly be utilized or adapted for use in at least one possible embodiment may possibly be found in the following patents: EP 0 999 137 A2, having the title "POUCH CARRYING APPARATUS," published on May 10, 2000; U.S. Pat. No. 5,862,653, having the title "FLEXIBLE PACKAGE HANDLING DEVICE," published on Jan. 26, 1999; and EP 0 765 807, having the title "MANIPULATOR DEVICE FOR HANDLING FLEXIBLE BAGS," published on Apr. 2, 1997.

Some examples of apparatuses for opening and disposing bags and of gripping arrangements that may possibly be utilized or adapted for use in at least one possible embodiment may possibly be found in the following U.S. patents: U.S. Pat. No. 4,108,300, having the title "BAG PACKING APPARATUS", issued on Aug. 22, 1978; and U.S. Pat. No. 6,276,117, having the title "ADJUSTABLE POUCH CARRIER FOR DIFFERENT SIZE POUCHES AND PACKAGING MACHINE HAVING AN ADJUSTABLE POUCH CARRIER", issued on Aug. 21, 2001.

Some examples of apparatuses for handling and closing arrangements that may possibly be utilized or adapted for use in at least one possible embodiment may possibly be found in United States Patent Publication 2007/0101684, having the title "Device For The Production Of Tubular Bags", published on May 10, 2007; and DE 697 00 644 T2, having the following English translation of the German title "SEALING MACHINE AND METHOD," published on Feb. 10, 2000; EP 1167210, having the title "CONTINUOUS CONTAINER-SUPPLYING APPARATUS," published on Jan. 2, 2002; U.S. Pat. No. 5,058,364, having the title "PACKAGING MACHINE ADAPTED TO CONVERT POUCHES FROM EDGEWISE ADVANCE TO BROADWISE ADVANCE," published on Oct. 22, 1991; and DE 197 44 899, having the following English translation of the German title "APPARATUS FOR TREATING FLEXIBLE BAGS," published on Apr. 15, 1999.

The corresponding foreign and international patent publication applications, namely, Federal Republic of Germany Patent Application No. 10 2007 015 754.3, filed on Mar. 30, 2007, having inventor Wilfried EHMER, and DE-OS 10 2007 015 754.3 and DE-PS 10 2007 015 754.3, and International Application No. PCT/EP2008/002050, filed on Mar. 14, 2008, having WIPO Publication No. WO 2008/119453 and inventor Wilfried EHMER, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the corresponding foreign equivalent patent application(s), that is, PCT/EP2008/002050 and German Patent Application 10 2007 015 754.3, is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2008/002050 and DE 10 2007 015 754.3 from which this patent application claims priority which do not have to do with the correction of the translation in this patent application are not to be included in this patent application in the incorporation by reference.

Any statements about admissions of prior art in the original foreign patent applications PCT/EP2008/002050 and DE 10 2007 015 754.3 are not to be included in this patent application in the incorporation by reference, since the laws relating to prior art in non-U.S. Patent Offices and courts may be substantially different from the Patent Laws of the United States.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1, 1*a* System
2 Packaging pouch
2.1 Strand of a multitude of packaging pouches 2
3 Conveyor
4 Sterilization device
5 Feed lock
6 Clean room of system 1 or 1*a*, respectively
7 High-pressure vessel
8 Interior chamber of the high-pressure vessel
9 Pressure source for the pressure medium
10 Feeding station
11 Removal station
12 System-internal conveyor
13 Filling station
14 Closing station
15 Flow of sterile air
16 Supply roll
17 Feeding device
18 Folding and forming station
A Direction of transport
P Process pressure

What is claimed is:

1. A method of sterilizing an unsterilized roll of packaging material comprising the steps of:

disposing the unsterilized roll of packaging material in a chamber of a sterilization device;

pressurizing a pressure medium in said chamber using a pressurization arrangement; and sterilizing the unsterilized roll of packaging material using solely the pressure of said pressure medium.

2. The method according to claim 1, wherein the step of pressurizing said pressure medium in the sterilization device comprises pressurizing said pressure medium to a pressure in a range from 3,000 to 7,000 bar.

3. The method according to claim 1, wherein said pressure medium is air, nitrogen, carbon dioxide, or inert gas.

4. The method according to claim 1, wherein the pressure medium is a gas prior to performing the step of pressurizing a pressure medium in the sterilization device and is a liquid after performing the step of pressurizing a pressure medium in the sterilization device.

5. The method according to claim 1, wherein the method further comprises a step of heating the pressure medium.

6. A sterilization device configured to perform the method according to claim 1 of sterilizing an unsterilized roll of packaging material and/or packages, said sterilization device comprising:

a chamber configured to receive at least one unsterilized roll of packaging material therein; and a pressurization arrangement configured to pressurize a pressure medium in said chamber, to thereby sterilize the at least one unsterilized roll of packaging material using solely the pressure of the pressure medium.

7. The sterilization device of claim 6 being configured to be pressurized up to 7,000 bar.

8. The sterilization device of claim 6, wherein said sterilization device further comprises a supply of a gas pressure medium and is configured to liquefy the gas pressure medium upon pressurizing the pressure medium in the sterilization device.

9. The sterilization device of claim 8 wherein said supply of gas pressure medium comprises a supply of air, nitrogen, carbon dioxide, or inert gas.

10. The method according to claim 1 wherein: said sterilization device further comprises a supply of gas pressure medium which said pressure medium is gaseous air, gaseous nitrogen, gaseous carbon dioxide, or inert gas;

said step of pressurizing a pressure medium in the sterilization device comprises pressurizing said pressure medium to a pressure in a range from 3,000 to 7,000 bar and liquefying the gaseous air, gaseous nitrogen, gaseous carbon dioxide, or inert gas pressure medium;

said method further comprises a step of heating said pressure medium; and the step of disposing the packaging material and/or packages in a sterilization device comprises at least one of a)-f), wherein a) disposing flat packaging material in the sterilization device;

b) disposing pouches in the sterilization device;

c) disposing flat material wound up into a roll in the sterilization device;

d) disposing pouches made of a flat material in the sterilization device;

e) disposing molded parts in the sterilization device; and f) disposing lock elements, caps, lids, screw tops, spouts, shoulder elements and the like in the sterilization device.

* * * * *

UNITED STATES PATENT AND TRADEMARK OFFICE

CERTIFICATE OF CORRECTION

PATENT NO. : 9,290,286 B2
APPLICATION NO. : 12/568852
DATED : March 22, 2016
INVENTOR(S) : Wilfried Ehmer It is certified that error appears in the above-identified patent and that said Letters Patent is hereby corrected as shown below:

In the Claims

In column 22, line 12 of Claim 10, after "pressure medium", delete "; and", and delete lines 13–27 of column 22.

Signed and Sealed this
Seventh Day of June, 2016

Michelle K. Lee

Michelle K. Lee
*Director of the United States Patent and Trademark Office*